US007178750B2

(12) United States Patent
Thiry

(10) Patent No.: US 7,178,750 B2
(45) Date of Patent: Feb. 20, 2007

(54) INLINE EVENFLOW MATERIAL DISTRIBUTOR FOR PNEUMATIC MATERIAL FEED SYSTEMS

(75) Inventor: Michael J. Thiry, Oakdale, CA (US)

(73) Assignee: The Regents of the University of Califfornia, Oakland, CA (US)

( * ) Notice: Subject to any disclaimer, the term of this patent is extended or adjusted under 35 U.S.C. 154(b) by 55 days.

(21) Appl. No.: 10/817,489

(22) Filed: Apr. 1, 2004

(65) Prior Publication Data

US 2005/0263628 A1 Dec. 1, 2005

(51) Int. Cl.
*B02C 19/00* (2006.01)

(52) U.S. Cl. ..... 241/40; 241/152.2; 451/99

(58) Field of Classification Search ..... 241/39, 241/40, 5, 152.2, 283; 451/99–102; 433/88
See application file for complete search history.

(56) References Cited

U.S. PATENT DOCUMENTS 4,059,231 A * 11/1977 Neu ..... 241/5
5,099,619 A * 3/1992 Rose ..... 451/99
5,312,040 A 5/1994 Woodward
5,358,183 A * 10/1994 Kanda et al. ..... 241/5
5,839,670 A * 11/1998 Omata et al. ..... 241/5
6,040,004 A 3/2000 Matsumoto et al.
6,726,549 B2 * 4/2004 Rivir et al. ..... 451/99

OTHER PUBLICATIONS

AbrasiveJet and WaterJet Machining: Introduction, http://www.waterjets.org/about_abrasivejets.html.

* cited by examiner

*Primary Examiner*—Mark Rosenbaum
(74) *Attorney, Agent, or Firm*—James S. Tak

(57) ABSTRACT

An apparatus for reducing clogs in a pneumatic material feed line, such as employed in abrasive waterjet machining systems, by providing an evenflow feed of material therethrough. The apparatus preferably includes a hollow housing defining a housing volume and having an inlet capable of connecting to an upstream portion of the pneumatic material feed line, an outlet capable of connecting to a downstream portion of the pneumatic material feed line, and an air vent located between the inlet and outlet for venting excess air pressure out from the housing volume. A diverter, i.e. an impingement object, is located at the inlet and in a path of incoming material from the upstream portion of the pneumatic material feed line, to break up clumps of ambient moisture-ridden material impinging on the diverter. And one or more filter screens is also preferably located in the housing volume to further break up clumps and provide filtering.

18 Claims, 3 Drawing Sheets

INLINE EVENFLOW MATERIAL DISTRIBUTOR FOR PNEUMATIC MATERIAL FEED SYSTEMS

The United States Government has rights in this invention pursuant to Contract No. W-7405-ENG48 between the United States Department of Energy and the University of California for the operation of Lawrence Livermore National Laboratory.

I. FIELD OF THE INVENTION

The present invention relates to pneumatic material delivery and feed methods and systems. More particularly, the present invention relates to an evenflow material distributor apparatus for breaking up bridged and agglomerated moisture-ridden abrasive material in a pneumatic material feed line and venting excess air pressure caused thereby, so as to prevent clogs in the material feed line and provide an evenflow feed of material through to, for example, an abrasive waterjet machining system.

II. BACKGROUND OF THE INVENTION

A waterjet and waterjet machining is a tool and process, respectively, using extremely high pressure water (typically between 20,000 and 50,000 psi) forced through a small orifice or "jewel" (typically 0.007" to 0.015" diameter) to produce a high velocity concentrated beam of water to cut relatively soft materials. And an abrasive waterjet (hereinafter "abrasivejet") and abrasivejet machining is a related tool and process, respectively, which uses the same high velocity beam of water to accelerate abrasive particles, such as garnet, to speeds fast enough to cut through much harder materials. Abrasive particles are introduced into the abrasivejet downstream of the jewel when water exiting the jewel creates a vacuum which sucks abrasive particles from the abrasive supply line. The abrasive particles mix with the water in a mixing tube of the abrasivejet before exiting the abrasivejet as a high velocity beam of abrasives.

Various types of pneumatic feed/delivery systems have been used to supply material through a feed line, and in particular feed abrasive particulate material to an abrasivejet. They typically involve a hopper and pneumatic source, such as an air compressor, at an upstream end of the feed system. And the hopper and pneumatic source are connected by a material feed line, such as a hose or pipe, to a second hopper at the abrasivejet. A known problem, however, often seen with this type of feed arrangement is the occurrence of clumping, bridging, and agglomeration of the abrasive particles in the delivery line caused by moisture and condensation from relative humidity. Excessive moisture has been known to develop especially in abrasive materials kept in storage for long periods of time. As a consequence, the bridging and clumping of the material in the delivery line can clog the delivery line until sufficient pressure builds in the line to clear the clog, thereby producing excessive/erratic air pressure and feed rates of the abrasive material to the mixing tube of the abrasivejet. This can disrupt the cutting action in waterjet machining and hamper productivity, as well as reduce edge quality of the machined part.

While various measures have been proposed to dry the abrasive prior to feeding it through the feed line (e.g. by baking-out the moisture using conveyor belts/inline drying system) complex and bulky subsystems are typically required which can significantly increase the cost of abrasivejet machining. Thus a need still exists for a simple efficient, and cost-effective apparatus for preventing clogs in an abrasive feed line by breaking up the clumps of bridged or agglomerated abrasive particles and venting excess air caused thereby, to promote evenflow distribution of material through the feed line. Moreover, it would be beneficial to provide an apparatus which is easily adaptable for use with any commercial delivery line of with little or no modifications.

III. SUMMARY OF THE INVENTION

One aspect of the present invention includes an apparatus for reducing clogs in a pneumatic material feed line, comprising: a hollow housing defining a housing volume and having an inlet capable of connecting to an upstream portion of the pneumatic material feed line, an outlet capable of connecting to a downstream portion of the pneumatic material feed line, and an air vent located between the inlet and outlet for venting excess air pressure out from the housing volume; and a diverter located at the inlet and in a path of incoming material from the upstream portion of the pneumatic material feed line, for breaking up clumps of said material impinging upon said diverter.

Another aspect of the present invention includes an evenflow material distribution apparatus for use in a pneumatic material feed line of an abrasive waterjet machining system, said pneumatic material feed line connecting a pneumatic source and an abrasive material supply at an upstream location to a hopper at a downstream location, comprising: a hollow housing defining a housing volume and having an inlet adapted to connect to an upstream portion of the pneumatic material feed line, an outlet adapted to connect to a downstream portion of the pneumatic material feed line, and an air vent located between the inlet and outlet for venting excess air pressure out from the housing volume; a diverter located at the inlet and in a path of incoming abrasive material from the upstream portion of the pneumatic material feed line, for breaking up clumps of said abrasive material impinging upon said diverter; a first filter screen having a first pore size and located in the housing volume between the diverter and the outlet, for further breaking up clumps of said abrasive material impinging upon said first filter screen and filtering therethrough abrasive material sized less than or equal to the first pore size; and a second filter screen having a second pore size and located in the housing volume between the first filter screen and the outlet, for further breaking up clumps of said abrasive material impinging upon said second filter screen and filtering therethrough abrasive material sized less than or equal to the second pore size, wherein the diverter, first filter screen, and second filter screen operate to reduce clogs in the pneumatic material feed line due to bridging/clumping of the abrasive material.

Another aspect of the present invention includes a pneumatic material feed line comprising: an upstream portion of the pneumatic material feed line; a downstream portion of the pneumatic material feed line; a hollow housing defining a housing volume and having an inlet connected to the upstream portion of the pneumatic material feed line, an outlet connected to the downstream portion of the pneumatic material feed line, and an air vent located between the inlet and outlet for venting excess air pressure out from the housing volume; and a diverter located at the inlet and in a path of incoming material from the upstream portion of the pneumatic material feed line, for breaking up clumps of said material impinging upon said diverter to reduce clogs in the pneumatic material feed line.

IV. BRIEF DESCRIPTION OF THE DRAWINGS

The accompanying drawings, which are incorporated into and form a part of the disclosure, are as follows.

V. DETAILED DESCRIPTION

The present invention is directed to an evenflow material distributor apparatus used inline with a material feed line of a pneumatic supply system to prevent clogs from forming in the feed line due to the presence of moisture-ridden abrasive clumps. The present invention is also directed to an improved pneumatic material feed line system for achieving the same purpose. The present invention operates not to correct the moisture levels in the abrasive, but rather to provide even distribution and flow of ambient moisture-ridden materials in the pneumatic supply system. In this manner, the evenflow material distributor apparatus allows the direct use of moisture-ridden abrasives in abrasivejet machining applications without the need for priming, drying, or otherwise preparing the material or the complex subsystems associated with such operations.

Figure 1:
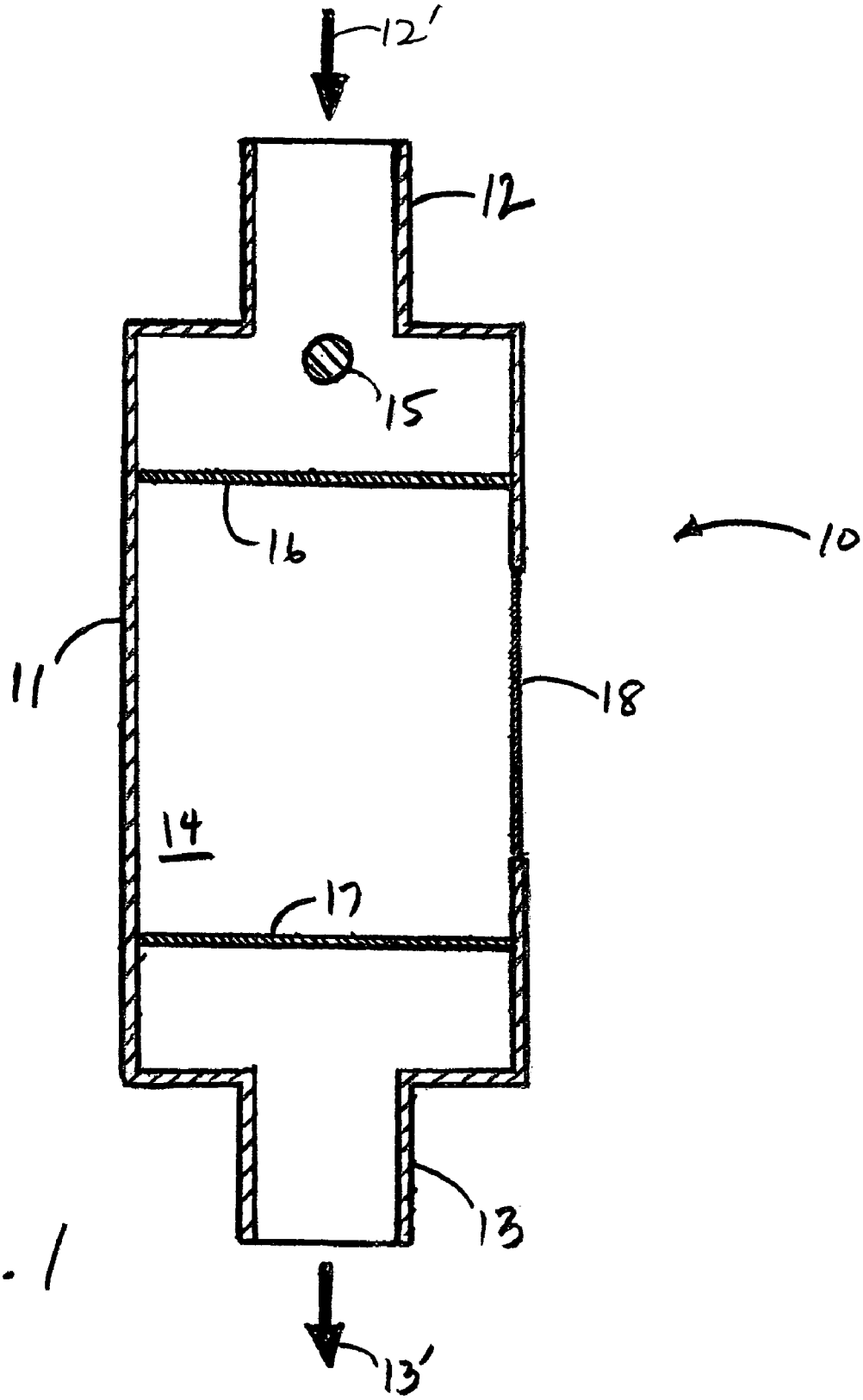
FIG. 1 is a cross-sectional view of an exemplary embodiment of the evenflow material distributor apparatus of the present invention.
Figure 2:
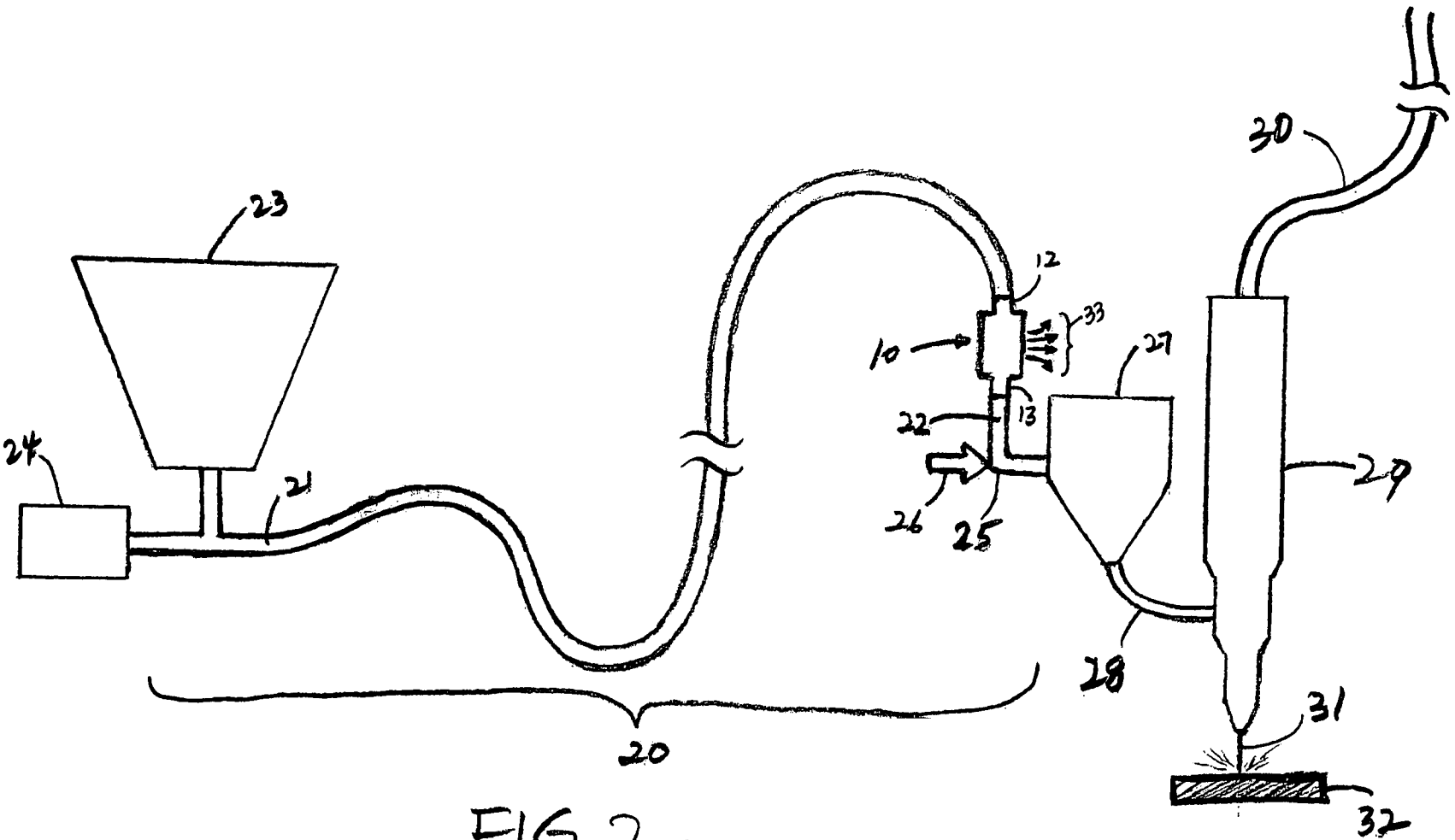
FIG. 2 is a schematic diagram of an abrasivejet machining system shown employing the evenflow material distributor apparatus of the present invention in a material feed line of the system.

Turning now to the drawings, FIG. 1 shows a cross-sectional view of an exemplary embodiment of the evenflow material distributor apparatus, generally indicated at 10. And FIG. 2 shows a schematic diagram of an abrasivejet machining system employing the evenflow material distributor apparatus 10 in a material feed line 20 of the system.

FIG. 1 shows in detail the apparatus 10 generally comprising a hollow housing 11 having an elongated configuration surrounding and defining a housing volume 14. The housing 11 has an inlet 12 and an outlet 13 at opposite ends thereof which allow abrasive material (not shown) to enter and exit, respectively, the housing 11 and the housing volume 14 as shown by arrows 12' and 13' indicating the flow direction of the abrasive feed.

At the inlet 12 (i.e. adjacent to, near, or in the inlet), a diverter, shown as a dowel pin or peg 15, is placed in the path of incoming abrasive particles to operate as an impingement device, whereby clumps of abrasive particles are broken up by impinging upon and flowing around the diverter 15. As such, the diverter may be characterized as an impingement object, and is shown centrally positioned at the inlet 12 and extending in a transverse direction to the incoming material flow. The diverter 15 operates as a first line of clump impingement to break up the largest clumps of abrasive particles.

Second and third lines of clump impingement is provided by a first filter screen 16 and a second filter screen 17. In particular, the first filter screen 16 is shown located upstream of the second filter screen 17 and positioned between the diverter 15 and the second filter screen 17. And the second filter screen 17 is positioned between the first filter screen 16 and the outlet 13. Both the first and second filter screens 16, 17 preferably have a screen mesh structure, with each having a predetermined pore or hole size, e.g. 100 grit (holes/inch), chosen to suit a particular application and abrasive type. In a preferred embodiment, the first filter screen 16 has a larger pore size than the second filter screen 17 to collect successively smaller debris and break up successively smaller abrasive clumps. Moreover, the filter screens also operate to size the abrasive particles entering the abrasivejet nozzle. In this regard, the last, i.e. second, filter screen 17 has a hole size sufficiently small to size and pass only abrasive particles smaller than the abrasivejet nozzle to prevent obstructing therein. It is appreciated that while only two filter screens are described, additional filter screens may be employed for further clump-breaking, screening, and sizing. Furthermore, the filter screens may be integrally constructed into the housing 11, or not.

FIG. 1 also shows an air vent 18 along a sidewall of the housing 11, and generally located downstream of the first filter screen 16 and upstream of the second filter screen 17. The air vent 18 is preferably a screen mesh having a pore size smaller than a single, unclumped abrasive particle to prevent particle leakage, while enabling the removable of excess air from the housing volume 14 and the feed line, and thereby preventing pressure build-up in the feed line due to clumping, bridging, and agglomeration. The removal of excess air pressure from the housing volume serves to correct for erratic air pressure increases which may be caused by the clumping, bridging, and agglomeration of material upstream of the apparatus. While the air vent in FIG. 1 is shown flush with the housing sidewall, supplementary flow channels/conduits may be alternatively provided leading from the housing volume 14 to the air vent 18, such as with a T-shaped PVC pipe.

In FIG. 2, the apparatus 10 is positioned to operate inline with the material feed line 20, shown as a hose, of the abrasivejet machining system. In particular, the inlet 12 of the apparatus 10 is connected to an upstream portion 21 of the feed line 20, and the outlet 13 is connected to a downstream portion 22 of the feed line. The upstream portion 21 in turn is connected to a first hopper 23 where the moisture-ridden abrasive material (not shown) is loaded. A pneumatic source, such as an air compressor 24 is operably connected to the feed line 20 such that abrasive material entering from the first hopper 23 is forced into the feed line. And the downstream portion 22 in turn leads material exiting the apparatus 10 to a delivery location, such as a second hopper 27 of an abrasivejet machining arrangement.

As shown in FIG. 2, the apparatus 10 is referably positioned at a substantially downstream location of the feed line 20 near the second hopper 27, such that clumped particles may be broken immediately prior to being released into the second hopper 27. In FIG. 2, the apparatus 10 is also shown vertically connected to the upstream and downstream segments of the material feed line, with the inlet 12 and outlet 13 at opposite ends of the housing, such that passage of material through the hollow housing is assisted in part by gravity, i.e. a gravity feed. The gravity feed would enable continued passage of the material through the housing, despite the venting of excess air pressure out through the air vent as shown by arrows 33, and without requiring an additional air pressure source to feed the material through the remainder of the downstream portion 22.

Figure 3:
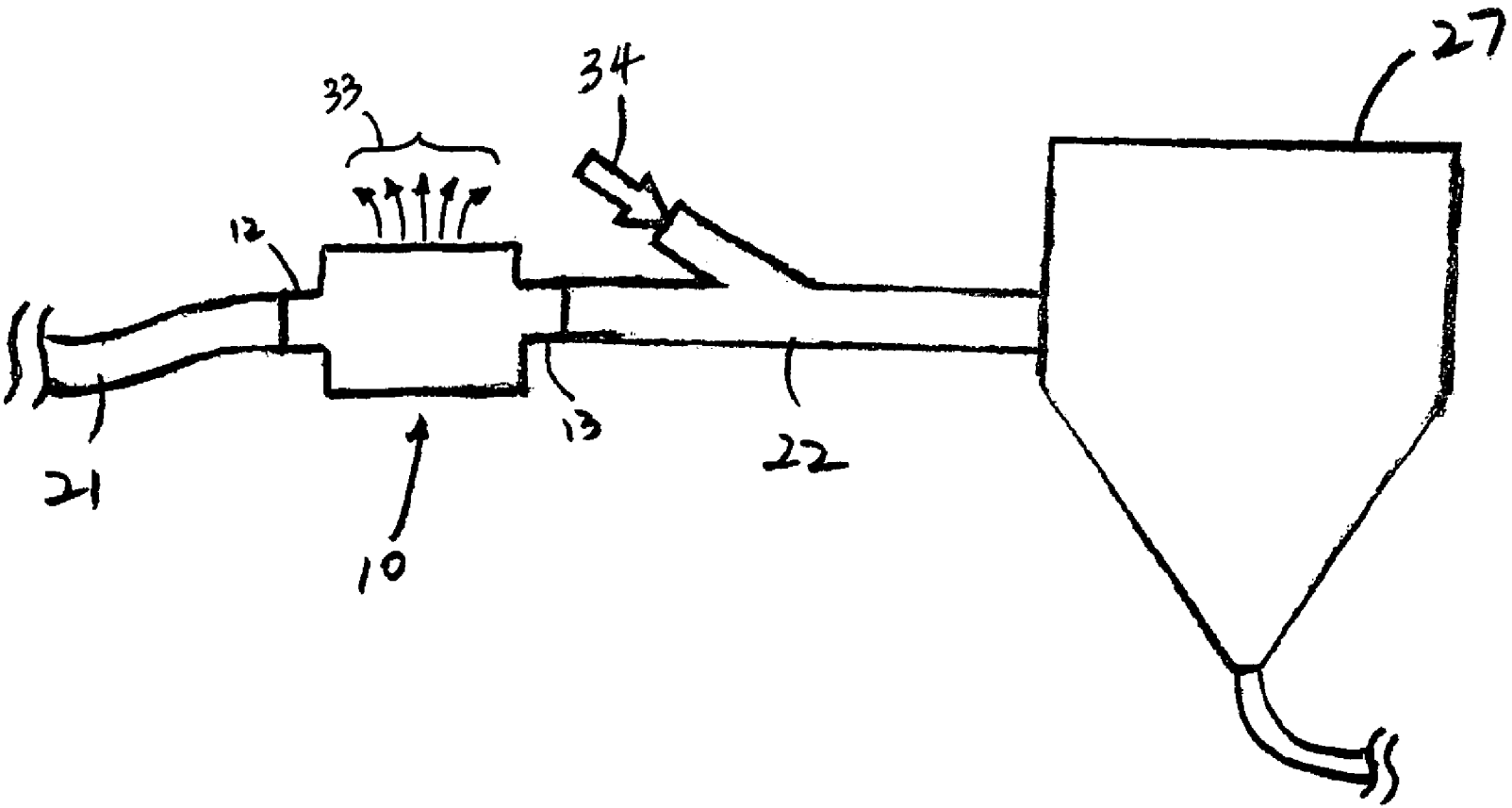
FIG. 3 is a schematic diagram of a material feed line shown employing the evenflow material distributor apparatus of the present invention and having a supplemental air injector 34 downstream of the evenflow material distributor apparatus.

As can be seen in FIGS. 2 and 3, however, a supplemental air injector, indicated at 26 in FIG. 2 and at 34 in FIG. 3, may also be utilized to further agitate the material for and through the remainder of the downstream portion 22. The is particularly beneficial where entry into the second hopper 27 is preceded by an elbow 25 in FIG. 2 where clumping may recur therethrough. To address this problem, a small amount of air is introduced at the elbow using a supplemental air injector indicated by arrow 26 to agitate and accelerate material in an orthogonal direction to that of entry into the elbow. As shown in FIG. 3, a supplemental air injector indicated by arrow 34, may also be utilized to agitate material exiting a horizontally-oriented apparatus 10 through the rest of the downstream portion 22. The air injector 34 is shown connected to the feed line using a Y-joint to provide direction injection of air pressure for agitation. Generally, an air injector may be located on the feed line 20 anywhere downstream of the evenflow material distributor apparatus 10 to supply additional pneumatic pressure in a direction of the feed and compensate for some of the pressure loss due to air venting at the housing 11.

As discussed in the Background, the vacuum generated by the accelerated water passing a jewel (not shown), sucks abrasive particles from the second hopper 27 through a last-stage feed line 28 and into the nozzle 29. In this regard, the last-stage feed line 28 is differentiated from the pneumatic material feed line 20 as not being driven by pneumatic pressure from the pneumatic source 24. In any case, upon entering the nozzle 29 downstream of the jewel, the abrasive particles are mixed with and accelerated by a water beam supplied by a high pressure water line 30, to produce an abrasive beam 31 used to machine an object or part such as 32.

While particular operational sequences, materials, temperatures, parameters, and particular embodiments have been described and or illustrated, such are not intended to be limiting. Modifications and changes may become apparent to those skilled in the art, and it is intended that the invention be limited only by the scope of the appended claims.

I claim:

1. An apparatus for reducing clogs in a pneumatic material feed line, comprising:

a hollow housing defining a housing volume and having an inlet capable of connecting to an upstream portion of the pneumatic material feed line, an outlet capable of connecting to a downstream portion of the pneumatic material feed line, and an air vent located between the inlet and outlet for venting excess air pressure out from the housing volume;

a diverter located at the inlet and in a path of incoming material from the upstream portion of the pneumatic material feed line, for breaking up clumps of said material impinging upon said diverter; and a first filter screen having a first pore size and located in the housing volume between the diverter and the outlet, for further breaking up clumps of said material impinging upon said first filter screen and filtering therethrough material sized less than or equal to the first pore size.

2. The apparatus of claim 1, wherein the diverter is a pin extending in a transverse direction to the incoming material flow.

3. The apparatus of claim 1, further comprising a second filter screen having a second pore size and located in the housing volume between the first filter screen and the outlet, for further breaking up clumps of said material impinging upon said second filter screen and filtering therethrough material sized less than or equal to the second pore size.

4. The apparatus of claim 3, wherein the first pore size of the first filter screen is larger than the second pore size of the second filter screen.

5. The apparatus of claim 1, wherein the inlet and the outlet are located at opposite ends of the housing.

6. An evenflow material distribution apparatus for use in a pneumatic material feed line of an abrasivejet machining system, said pneumatic material feed line connecting a pneumatic source and an abrasive material supply at an upstream location to a hopper at a downstream location, comprising:

a hollow housing defining a housing volume and having an inlet adapted to connect to an upstream portion of the pneumatic material feed line, an outlet adapted to connect to a downstream portion of the pneumatic material feed line, and an air vent located between the inlet and outlet for venting excess air pressure out from the housing volume;

a diverter located at the inlet and in a path of incoming abrasive material from the upstream portion of the pneumatic material feed line, for breaking up clumps of said abrasive material impinging upon said diverter;

a first filter screen having a first pore size and located in the housing volume between the diverter and the outlet, for further breaking up clumps of said abrasive material impinging upon said first filter screen and filtering therethrough abrasive material sized less than or equal to the first pore size; and a second filter screen having a second pore size and located in the housing volume between the first filter screen and the outlet, for further breaking up clumps of said abrasive material impinging upon said second filter screen and filtering therethrough abrasive material sized less than or equal to the second pore size, wherein the diverter, first filter screen, and second filter screen operate to reduce clogs in the pneumatic material feed line due to bridging/clumping of the abrasive material.

7. The evenflow material distribution apparatus of claim 6, wherein the diverter is a pin extending in a transverse direction to the incoming abrasive material flow.

8. The evenflow material distribution apparatus of claim 6, wherein the first pore size of the first filter screen is larger than the second pore size of the second filter screen.

9. The evenflow material distribution apparatus of claim 6, wherein the inlet and the outlet are located at opposite ends of the housing.

10. A pneumatic material feed line comprising:

an upstream portion of the pneumatic material feed line;

a downstream portion of the pneumatic material feed line;

a hollow housing defining a housing volume and having an inlet connected to the upstream portion of the pneumatic material feed line, an outlet connected to the downstream portion of the pneumatic material feed line, and an air vent located between the inlet and outlet for venting excess air pressure out from the housing volume;

a diverter located at the inlet and in a path of incoming material from the upstream portion of the pneumatic material feed line, for breaking up clumps of said material impinging upon said diverter to reduce clogs in the pneumatic material feed line; and a first filter screen having a first pore size and located in the housing volume between the diverter and the outlet, for further breaking up clumps of said material impinging upon said first filter screen and filtering therethrough material sized less than or equal to the first pore size.

11. The pneumatic material feed line of claim 10, wherein the diverter is a pin extending in a transverse direction to the incoming material flow.

12. The pneumatic material feed line of claim 10, further comprising a second filter screen having a second pore size and located in the housing volume between the first filter screen and the outlet, for further breaking up clumps of said material impinging upon said second filter screen and filtering therethrough material sized less than or equal to the second pore size.

13. The pneumatic material feed line of claim 12, wherein the first pore size of the first filter screen is larger than the second pore size of the second filter screen.

14. The pneumatic material feed line of claim 10, wherein the inlet and the outlet are located at opposite ends of the housing.

15. The pneumatic material feed line of claim 10, further comprising an air injector located downstream of the housing for supplying additional pneumatic pressure in a direction of the feed.

16. The pneumatic material feed line of claim 15, wherein the air injector is located at an elbow of the pneumatic material feed line to accelerate material in an orthogonal direction to that of entry into the elbow.

17. The pneumatic material feed line of claim 10, wherein the pneumatic material feed line supplies abrasive material to an abrasive waterjet machining system.

18. The pneumatic material feed line of claim 17, wherein the pneumatic material feed line connects a pneumatic source and an abrasive material supply at an upstream location to a hopper at a downstream location.

* * * * *